United States Patent [19]

Barta et al.

[11] 4,131,713

[45] Dec. 26, 1978

[54] LEATHER YARN PRODUCT AND METHOD OF MANUFACTURE

[75] Inventors: Leslie P. Barta, Murray, Utah; William M. Alexander, 1835 Elmwood Dr., Hillsborough, Calif. 94010

[73] Assignee: William M. Alexander, Hillsborough, Calif.

[21] Appl. No.: 807,361

[22] Filed: Jun. 17, 1977

Related U.S. Application Data

[63] Continuation-in-part of Ser. No. 467,887, May 8, 1974, abandoned.

[51] Int. Cl.[2] ..... C14B 9/00; D03D 15/00

[52] U.S. Cl. ..... 428/364; 66/202; 69/21; 139/420 R; 428/401

[58] Field of Search ..... 24/143 R; 66/202; 69/21; 428/364, 401; 139/420 R; 8/94.2

[56] References Cited

U.S. PATENT DOCUMENTS

| | | | |
|---|---|---|---|
| 86,755 | 2/1869 | Hurn | 69/21 |
| 1,713,113 | 5/1929 | Cavanaugh | 139/420 R |
| 2,067,895 | 1/1937 | Arbib | 66/202 |
| 2,374,836 | 5/1945 | Ruedebush | 8/94.2 |

*Primary Examiner*—J.C. Cannon

*Attorney, Agent, or Firm*—Thomas M. Freiburger

[57] ABSTRACT

A leather yarn embodies a novel combination of five parameters which enables the leather yarn to be readily worked by garment knitting machine needlework into a unique knitted fabric having a soft "leather hand".

The parameters are:

1. Softness;
2. Consistent Thinness of Depth;
3. Consistent Narrowness of Width;
4. Adequate Tensile Strength; and
5. Continuity.

The leather yarn is cut from a thin leather having a weight in the range of about 3 oz. to 1½ oz. as measured by a standard leather thickness gauge such as the Woburn ounce weight caliber, made by the Woburn Machine Company, Woburn, Massachusetts.

The softness parameter is obtained by the selection of a leather with the softness characteristics of fine garment/dress glove leather (a standard category in the tanning industry).

The consistent narrowness of width and thinness of depth (and manufacture of the yarn at a marketable cost) is obtained by a number of specifically interrelated machine cutting operations. These specific cutting operations are employed to produce a leather yarn having specific physical characteristics which avoid subsequent jamming and breaking of the leather yarn in the knitting machinery which utilizes the yarn.

The continuity of these significant properties is secured by the selection of an appropriate raw skin, (preferably a young animal) and by the selection of a tanner who produces fine garment/dress glove leather, and by machine cutting to produce long uniform lengths without splices. (Both selections are well within the ability of anyone having ordinary skill in the leather art).

The tensile strength is insured again by the proper selection of skin and its tannage in accordance with a standard leather industry category, that is, fine garment/-dress glove leather.

The purpose of these five (5) parameters is that when combined they render a leather yarn capable of being knit on kitting machines and by needlework into fashion garments.

13 Claims, 17 Drawing Figures

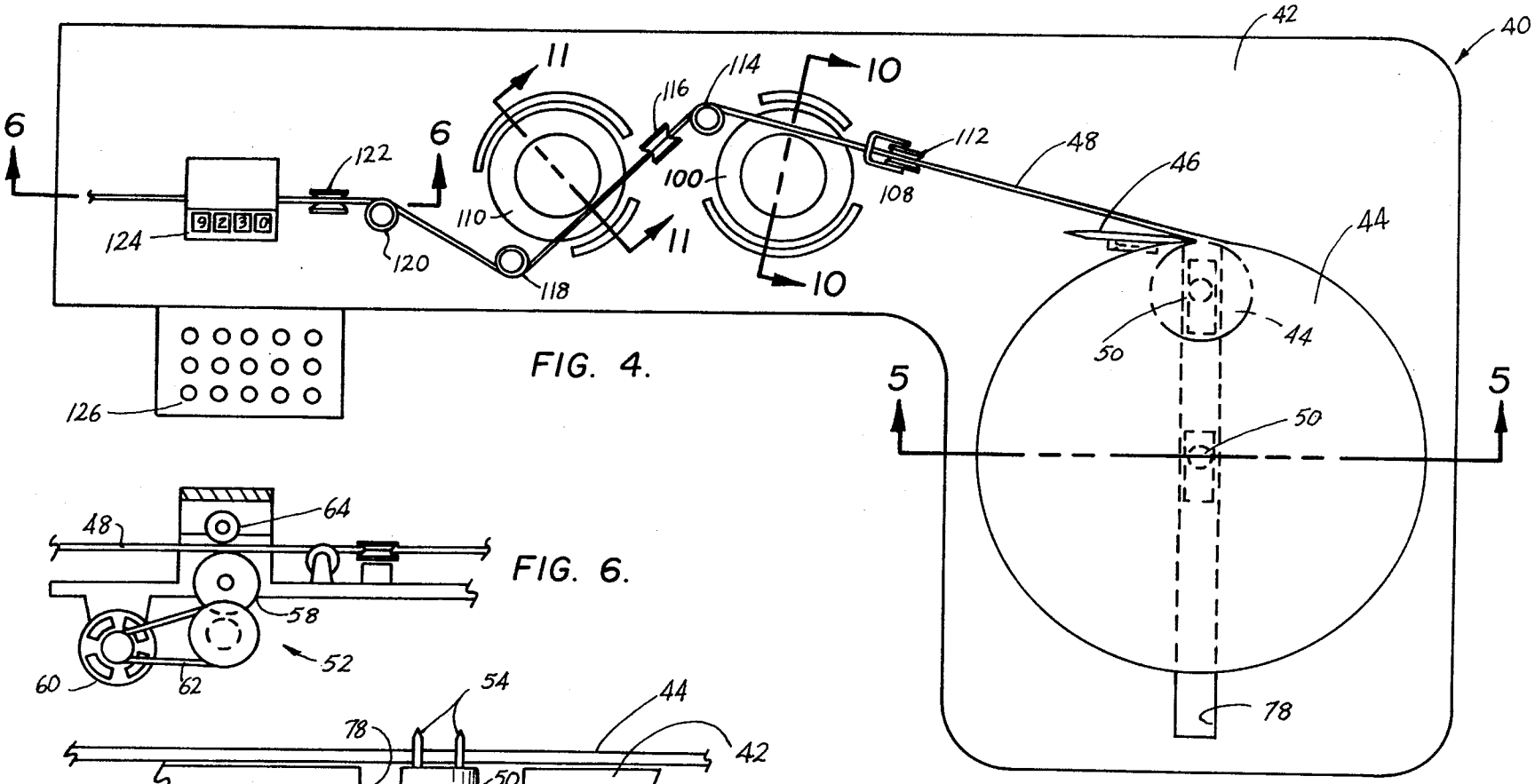
FIG. 4.
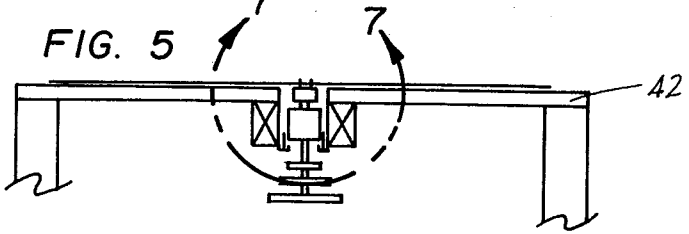
FIG. 5
FIG. 6.
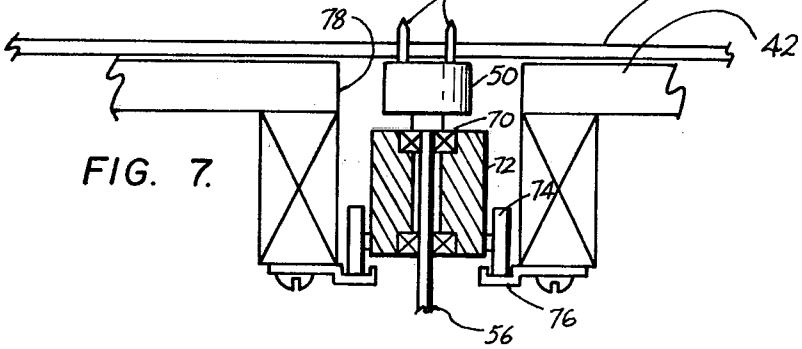
FIG. 7.

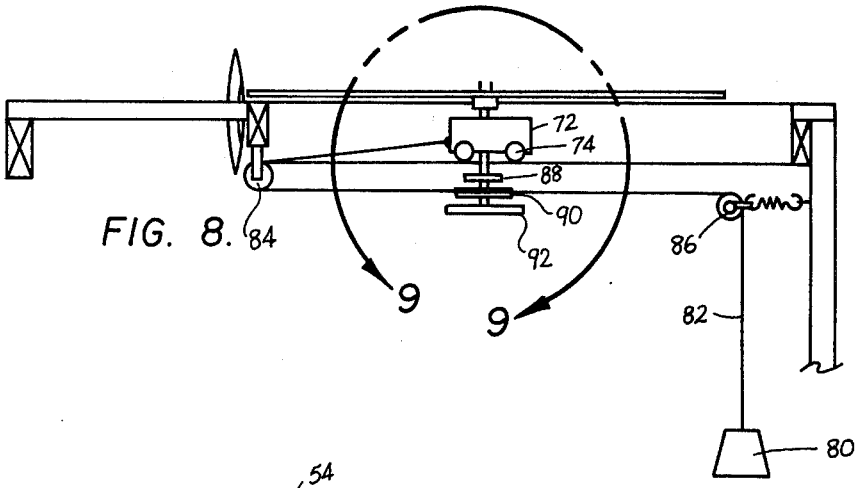
FIG. 8.
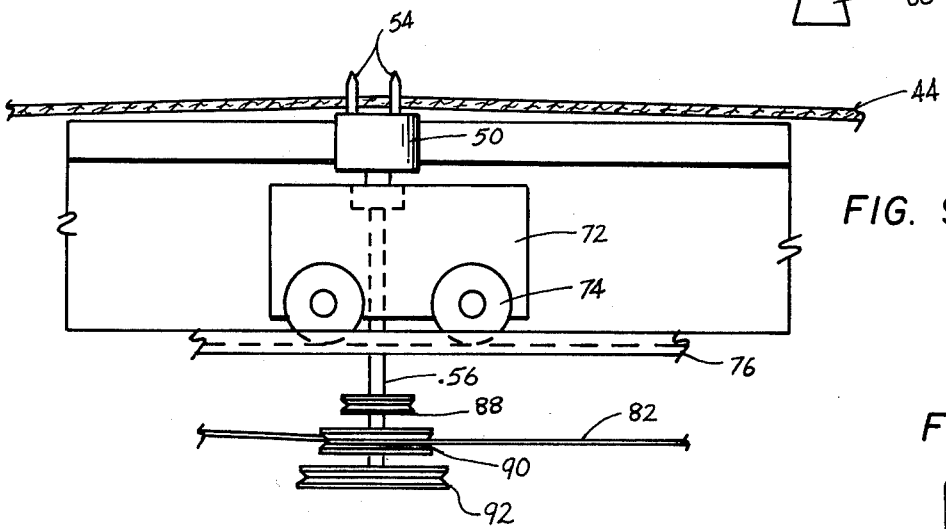
FIG. 9.
FIG. 12.
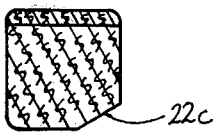
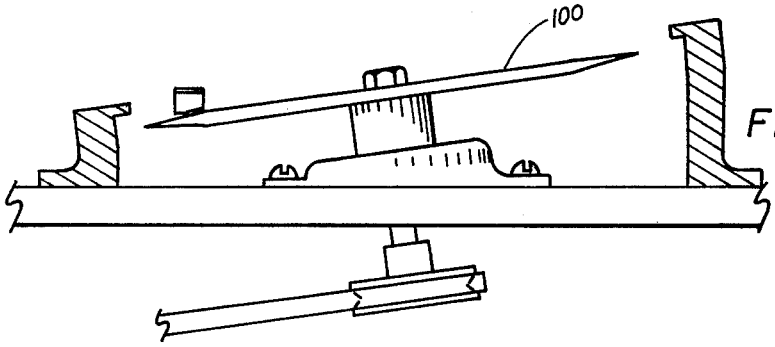
FIG. 10.
FIG. 13.
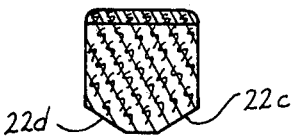
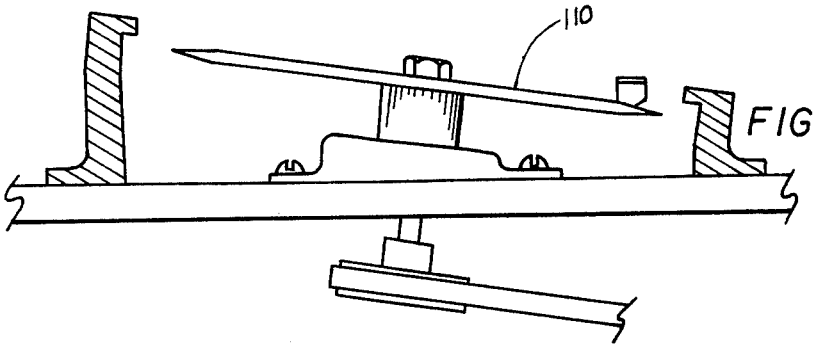
FIG. 11.

LEATHER YARN PRODUCT AND METHOD OF MANUFACTURE

SPECIFICATION

This application is a continuation-in-part of prior United States Application Ser. No. 467,887 filed May 8, 1974 by Leslie P. Barta, and now abandoned.

BACKGROUND OF THE INVENTION

This invention relates to a yarn product and to a method of making a yarn product.

It relates particularly to an untwisted single strand continuous yarn of fine garment/dress glove leather suitable for and used on knitting machinery for the purpose of making garments, especially ladies' fashions.

To obtain an understanding of the unique leather yarn of the present invention, a review of the general characteristics of yarns is helpful.

A yarn is a narrow, continuous strand of natural or synthetic material to be used for knitting, crocheting and associated arts.

The yarn is usually made from either a twisted aggregate of fibers spun out to considerable length or from some other ductile substance drawn out to suitable dimensions.

To better understand yarns, it is useful to look at the nature of fibers, the fundamental units used in the making of textile yarns and fabrics. Fibers are hair-like substances that are small in diameter in relation to their length. Examples are the fine hairs of the mature cotton ball and the fine secretions of the silk worm.

There are two basic forms of fibers. First there are staple fibers (natural and synthetic) giving spun yarns, e.g. cotton and rayon.

Secondly, there are filament fibers (natural and synthetic) giving continuous filament yarns, e.g. silk, nylon.

Staple fibers are a bunch of short fibers generally from ½ inch to 24 inches long that are later spun into a continuous strand held together by the inherent cohesive properties of the fiber, i.e. the wavy shape and irregular surfaces of each fiber that hook onto one another, when twisted and drawn out, forming a continuous line.

Filament fibers are individual fibers which are continuous or long in length to begin with, such as silk, the only natural filament fiber. A monofilament is a long, continuous, single fiber of high strength, such as a nylon fishing line. A multifilament is a number of fine monofilaments wound together to form a strand.

Many fibers abound in nature that are not used for making yarn because they lack the combination of properties that make yarns spinnable and suitable for yarn making. These properties include length, pliability, strength and cohesiveness.

Spinning is a series of mechanical operations designed to clean and parallel fibers, to draw them into a fine strand, and to twist them to make a spun yarn. Some fibers must go through all these operations. Others, such as silk, only go through the twisting and winding. There is also chemical spinning done by the extrusion of a substance solution (such as nylon) through a spinnaret into fine strands.

Silk alone is a natural continuous strand of length, and yet it is wound and twisted, for it is not indefinite in length, nor strong enough in a single strand for most purposes.

Of course, many fibers that are spinnable fail for other reasons — availability, cost, etc.

Rawhide, the starting material for the yarn of the present invention, is technically neither a staple fiber nor a filament fiber, but is comprised of an aggregate of fibril material (dermis), surmounted with a smooth surface (epidermis). This aggregate of rawhide fibers inherently possesses the properties of cohesiveness, pliability, and strength. The only remaining characteristic of fiber (found suitable for making yarn) missing in rawhide is the long thin length. To achieve this property the rawhide is not spun, but instead is prepared to the standard tannage of fine garment/dress glove leather, and then undergoes a specialized cutting process that renders it into a long narrow thin continuous strand. Thus leather yarn is an aggregate of fibers held together by proteinous substances cut, instead of spun, into a long continuous untwisted single strand.

In this state, the present invention provides a strand of natural protein fiber (like silk and wool in this respect), which has the properties of a natural filament fiber such as silk, but which is larger in diameter with a "leather hand" and which has no need to be spun or twisted.

Although two other products (leather lace and leather strips used for macrame) have been commercially produced, neither has approached the workability characteristics of other ordinary yarn, nor the properties needed for knitting machinery, which the present invention has. The present invention provides a genuine continuous, uniform, untwisted single strand leather yarn (as will become more apparent from the description that follows) suitable for fine garment knitting on knitting machinery (fine garment as opposed to working garments).

The general concept of a leather yarn which can be used for hand or machine knitting is not novel. For example, U.S. Pat. No. 2,067,895 issued Jan. 19, 1937 to Ida Arbib, relates to a leather yarn product and points out that a leather yarn may be produced by a spiral cut from a soft, suede-like material. However, the Arbib patent discloses only the general concept of a leather yarn. The Arbib patent does not disclose the specific and interrelated characteristics that must be incorporated in a leather yarn product in order for the yarn to be commercial acceptable (and which characteristics become particularly critical in the case of a leather yarn to be used in machine knitting). The Arbib patent also fails to disclose specific techniques for enabling soft leather (required to provide sufficient flexibility in the yarn) to be cut to the narrow widths desired and with the uniformity required for fine garment knitting machinery while avoiding the major stumbling blocks (such, for example, as the pronounced tendency of soft leather to bunch up upon being cut) which are inherent in the cutting of soft leathers to narrow widths and close tolerances.

The problems encountered in producing a commercially acceptable leather yarn result from several reasons. These include the nature of the leather industry itself, the characteristics of the fine garment/dress leather, the relatively small size and the relatively high precision to which the leather yarn must be cut, and the necessity of removing deposits of tannage and natural oils and fibrous deposits from the cut yarn before use in knitting channels of knitting machines.

Traditionally many of the tanning companies are family owned, and the different tanners often use their own methods and modifications in their tannages; and there has been a distinct lack of objective criteria in the industry concerning leather. For example, different tanners have different color combinations and may make minor alterations to the basic tannage. There has been very little tensile strength testing apparatus for soft leather; because, until the present invention, there appeared no purpose for such apparatus. Softness indicators are also generally lacking and softness is instead based on subjective knowledge understood by those skilled in the trade. This subjective perception thus determines the category of the leather, such as, fine garment/dress glove leather.

After a leather having the required combination of softness and strength is obtained, it must be cut to the thickness and width dimensions of yarn which can be utilized in machine knitting operations. This requires, as a practical and economic matter, that a machine cutting operation has to be used. Hand cutting cannot maintain the tolerances required and is much too expensive.

Soft leather, because it is soft, tends to bunch easily in front of a cutting blade. This bunching tendency makes it difficult to cut soft leather to relatively narrow widths and to a relatively high uniformity or precision in the narrow widths. Any wrinkles or bunching passing the cutting blade cause either a break in the yarn or a distortion in the width. As a practical matter, to obtain the precise cutting of soft leathers to small widths, the surface area of the whole piece of leather to be cut must be secured, and the cut must be made with a sharp blade and without too large a differential between the relative speed of the blade and the piece of leather being cut along the direction of the cut and also without exerting too much of a stretching force on any part of the leather being cut.

To obtain the greatest length with minimum splices, the leather yarn is cut as a strip from the outer periphery, and this results in cutting the yarn from a piece of leather which continually gets smaller in diameter. The larger the diameter of the leather disc the greater the problems of bunching of the soft leather in front of the cutting blade become greater. The resistance to the ripple/wave effect increases as the uncut piece of leather gets smaller in diameter. Also, when the leather piece being cut is mounted on a turntable (so as to be rotated past a cutting blade at a fixed location of the cutting blade) and when the strand being cut is used to produce the rotation of the leather being cut, the leather circle spins faster and faster as it gets smaller to keep up with the constant take-off rate of the strand being cut. This pulling action also tends to cause elliptical circular cuts to build up in the leather disc, and this elliptical shape further tends to pass a doubled-up wrinkle past the cutting blade. As will be described in more detail below, the present invention overcomes these problems of the prior art by providing a temporary stiffening of the leather being cut, to minimize the tendency of the soft leather to bunch. Furthermore, the present invention provides the temporary stiffening in a way that permits the temporary stiffening to be readily removed after the cutting has been accomplished so that the cut leather yarn can reassume its natural soft state.

As noted above, the knitting channels of knitting machines are quite sensitive to becoming jammed by dirt and oil. When this occurs, the yarns can become caught and can break in the knitting channels; and this in turn causes down time of the machine. Leather, by its nature, has a certain amount of oiliness and fibrous material, and it is important for a commercially acceptable leather yarn that excess oil and loose fibrous material be removed from the surface of the yarn before the yarn is used with the knitting machines.

As will be described in greater detail below, the present invention provides, as a part of the manufacture of the yarn, an intentional amount of manipulation of the yarn which has the effect of scraping off excess oil and loose material. The present invention also provides for beveling cuts which help remove loose fibril material.

The knowledge (that was lacking in the prior art) to enable a commercially acceptable leather yarn to be produced with the size, uniformity of dimensions, tensile strength, softness characteristics, and freedom of deposits of tannage, natural oils and fibril materials, all as required for machine knitting operations, has been made available by the present invention.

U.S. Pat. No. 86,755 issued Feb. 9, 1869 to G. and D. Hurn illustrates, like the Arbib patent, the cutting of a leather strip from the outer periphery of a piece of leather. The piece cut is then woven, with another leather or vegetable fiber, into a fabric. While the Hurn patent does not specify the type of leather from which the strip is cut, it appears that the Hurn patent relates to the cutting of a relatively hard leather because the patent mentions the subsequent use of the woven fabric as driving belts and harness strips and also because the patent refers to removing abrupt angles and curves from the cut strip by stretching, dampening, greasing, rolling, hammering and other equivalent operations on the cut strip. Abrupt angles and curves indicate that the cut strip of the Hurn patent is neither consistent nor uniform, and these are characteristics which are essential for a machine knitable leather yarn. The Hurn patent, like the Arbib patent, lacks any showing or suggestion of detailed specifications and descriptions of cutting operations and techniques required to produce a commercially acceptable machine knitable leather yarn. The Hurn patent instead appears to be directed to leather cutting of lace leather.

The leathers used for making lace leather are often quite thin, and the weight of such leathers can be made lighter for the corresponding skin size than the weight of garment leather. This is so because lace leathers are treated with chemicals and/or machines which maintain or reinforce both the tensile strength and the rigidity of the leather. This produces however, a very stiff leather, which happens to be a desirable quality for its intended purpose. The stiffness provides a sturdiness which allows the subsequent lace cutting process to work. Thus, while the lace product, after cutting, is a thin and narrow strip of leather, it is so stiff as to be well removed from any possible application as a yarn in a fabric knitted by needlework for fine clothing or on a knitting machine for similar purpose.

U.S. Pat. No. 2,781,532 issued Feb. 19, 1957 to H. H. Hoffman; U.S. Pat. No. 1,459,888 issued June 26, 1923 to M. D. Heyman and U.S. Pat. No. 1,937,399 issued Nov. 28, 1933 to W. Bateman are examples of lace leather cutting apparatus and methods and products. The lace leather products as produced by the Hoffman, Heyman and Bateman patent disclosures are not, as noted above, suitable for use as yarns in knitting machines.

U.S. Pat. No. 1,713,113 issued May 14, 1929 to W. M. Cavanaugh makes reference to a leather yarn product, but the description of the product makes it clear that the product described is not suitable for use as a yarn in a knitting machine. The yarn is described as a leather strip product of small length and having a width of ½ inch which is folded about inner fibrous threads to a tubular form. A number of such folded leather strips are aligned end to end and then twisted in a way such that a strand thus formed has a smooth leather outer surface for subsequent use in weaving in a loom. The relatively heavy, twisted yarns produced by the Cavanaugh patent process would necessarily have a resistance which defeats the soft pliability required for use as a yarn in a knitting machine, and any fabric made from such leather yarns would not be appropriate for fashion clothing.

Macrame is a course lace or fringe made by knotting threads or cords in a geometric pattern.

Macrameing is done by hand. The leathers that were made for knot tying had to be relatively soft and flexible. However, such leathers are not light weight and are not within the claimed dimensions of this invention.

It works against the use of leather for macrameing to make the leather too light weight. While (on first impression) the appearance of a macrame lace might have a superficial similarity to the leather yarn of the present invention, the macrame lace and this leather yarn are different products having sufficiently different physical characteristics that render macrame lace unsuitable for the needlework use of the yarn of the present invention. The macrame leather lace is too heavy to bend in the abrupt ways required for needlework such as crocheting and especially machine knitting. Macrame lace lacks the thinness and/or the narrowness, softness, or pliability which is required for the bending involved in needlework and knitting machinery. It also slows down crocheting considerably. Macrame leather lace is too heavy to bend in the way required for crocheting. Thus, fabric made from macrame lace does not have the hand or drape of a fabric knitted from the yarn of the present invention.

SUMMARY OF THE INVENTION

It is a primary object of the present invention to produce a leather yarn that is a long, very soft, adequately strong for machine knitting for fine clothing, narrow, uniform and continuous untwisted, single strand having a light weight (thickness) and which can be readily worked by machine or hand needlework into a knitted fabric for fine apparel clothing in essentially the same way as other yarn used for such needlework.

It is a related object to combine the attractive knitwear designs which are becoming fashionable with the timeless feel of leather through this new yarn material. It is another related object to manufacture the leather yarn in a way that keeps the cost low enough to make it marketable.

The present invention thus involves the intentional development of an untwisted single strand of continuous soft leather for use as a yarn in knitted fabrics made by needlework especially for knitting by machinery of apparel clothing.

The present invention starts with the selection of a skin (raw) having sufficient grain density to provide strength (in the final narrow and thin strand) adequate for the machine requirements of knitting and adequate for the requirements of fashion wear (as opposed to the fabric strength requirements of utilitarian clothing).

The proper weight (thinness) is obtained by shaving off part of the thickness of the hide if necessary. This is a standard process in the leather industry and is called "splitting". This process takes a hide and splits it horizontally into two or more pieces with the same or nearly the same square area as the original piece.

The processing of a skin, called a "tannage", requires as required for a leather to be used in the process of the present invention, the tanning and fat liquoring operation to produce a leather with a high degree of softness equal to the industry standard of fine garment/dress glove leather. No claim for any tannage process is part of this application.

The end result of this processing of the leather skin is then a light weight, very soft leather, having a grain density sufficient to provide the required strength in this leather yarn for the above mentioned needleworking.

The next step is to prepare the leather skin for a machine cutting operation. Since the very soft leather is subject to bunching up during the cutting, which bunching up can cause unacceptable unevenness in the width of the cut, or render the leather completely uncuttable, or worse, cause breakage, the leather is temporarily stiffened prior to cutting. One specific technique used is a temporary stiffening of the leather through the application of a "sizing" compound. The leather is then placed onto a finely tuned and balanced cutting machine which forms of the leather a long continuous, uniform, untwisted single strand of leather having the narrowness and continuity of cross-section size required for use as a machine knittable yarn.

The temporary sizing is removed from the cut yarn as a result of the intentional handling involved both during the cutting operations and afterwards. The purpose of these intentional operations is to return the yarn to its original softness, a requirement for its use as a machine knittable yarn. The handling involves several windings and reverse curving and bending of the yarn, which bending causes the temporary sizing compound to flake off of the leather yarn. The sizing compound lies only on the surface of the whole hide and does not penetrate the skins to any great degree. Thus, it allows itself to be removed in the above manner.

Another method for the temporary stiffening of the leather hide, so that it might be cut into yarn, is to affix a stiff paper or cardboard to the whole hide and then to cut through both of these materials. Afterwards, one removes the backing. This method is not preferred because it is not as economically feasible as the use of sizing and causes all kinds of problems in the winding and other processes immediately after the cut. It also dulls the blade considerably which increases the difficulties of cutting.

In a particular machine cutting operation, the yarn is cut by rotating the periphery of the skin past a cutting blade while moving the center of the skin inward toward the cutting blade at an increasing rate, which compensates for the decreasing diameter of the skin as the long continuous strand is cut from the leather disc. The strand is pulled by a yard counter/roller pincher, with the decreasing circle speeding up its rotation in order to meet the constant pull of the strand and compensate for the decreasing diameter of the leather disc.

The leather is placed grain side down on the cutting table to minimize the friction between the moving skin and the upper surface of the supporting surface of the cutter. This helps to avoid bunching and uneven cutting.

The cut yarn is wound on spools for subsequent use with existing feed mechanisms of knitting machines.

The cutting and winding operation incorporates guide pulleys and eyelets which produce an intentional scraping and manipulation of the yarn to remove loose fibril material which could clog up the machine knitting mechanism. The intentional manipulating and scraping of the cut yarn also removes the temporary stiffening agent and any excess oiliness of the leather yarn so that the yarn, when spooled, is in the desired soft, pliable condition of the fine garment/dress glove leather piece prior to the temporary stiffening and the yarn is also free of loose fibril material and excess oiliness.

The cut yarn as spooled has the five parameters (softness, consistent thinness of depth, consistent narrowness of width, adequate tensile strength, and continuity) required for the leathery yarn to be readily worked by garment knitting machine needlework into a knitted fabric having a soft "leather hand".

Leather yarn methods and products which incorporate the structure and techniques described above constitute further, specific objects of the present invention.

Other and further objects of the present invention will be apparent from the following description and claims and are illustrated in the accompanying drawings which, by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWINGS

FIG. 4 is a top plan view of a machine used for maching cutting a leather yarn in accordance with one embodiment of the present invention.

FIG. 5 is an elevation view taken along the line and in the direction indicated by the arrows 5—5 in FIG. 6 and shows the spindle for rotating and sliding the leather skin into position with respect to the cutting blade at the periphery of the skin.

FIG. 6 is a side elevation view taken along the line and in the direction indicated by the arrows 6—6 in FIG. 4 and shows a roller drive for pulling the cut yarn through the machine as it is cut off of the skin.

FIG. 7 is a fragmentary enlarged view of the part of the structure shown encircled by the arrows 7—7 in FIG. 5;

FIG. 8 is a side elevation view showing the mechanism for moving the center of the skin outward toward the cutting blade as the diameter of the skin decreases during the cutting operation on the periphery of the skin;

FIG. 9 is a fragmentary enlarged view of part of the structure shown encircled by the arrows 9—9 in FIG. 8;

FIG. 10 is an enlarged side view taken along the line and in the direction indicated by the arrows 10—10 in FIG. 4;

FIG. 11 is an enlarged side elevation view taken along the line and in the direction indicated by the arrows 11—11 in FIG. 4;

FIG. 12 is an enlarged side elevation view in cross-section through the leather strand after it has been cut by the beveling blade (shown in FIG. 10) to remove loose fibril material;

FIG. 13 is a view like FIG. 12 showing a leather strand after it has been bevelled (i.e. with most loose fibril material removed) by the cutting blade shown in FIG. 11;

DESCRIPTION OF THE PREFERRED EMBODIMENTS

Figure 1:
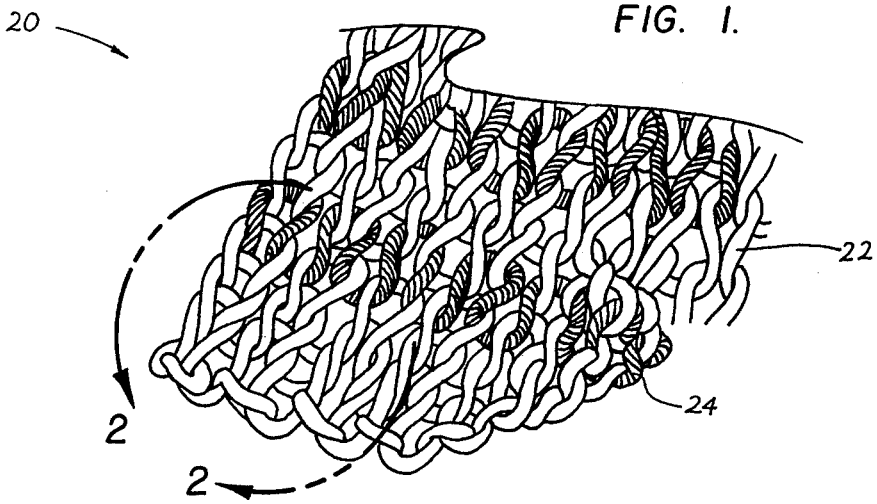
FIG. 1 is a perspective view of a part of a knitted fabric made by needlework and incorporating a leather yarn embodying the present invention. The fabric shown in FIG. 1 also shows how the leather yarn can be used with another non-leather yarn (in this case wool) in accordance with the present invention.

A fabric knitted by needlework and incorporating a leather yarn embodying the present invention is indicated generally by the reference numeral 20 in FIG. 1.

The fabric 20 comprises a leather yarn 22 and a yarn 24 of non-leather material, in this case wool.

Figure 2:
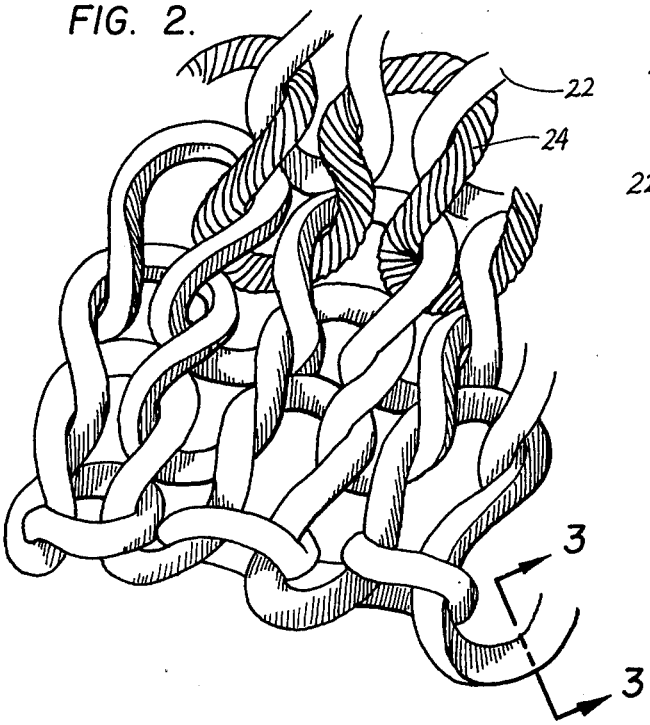
FIG. 2 is an enlarged view of the part of the fabric shown encircled by the arrows 2—2 in FIG. 1.

As illustrated in FIG. 1 and the enlarged FIG. 2, the leather yarn 22 of the present invention is incorporated in the knitted fabric in essentially the same way as other, wool yarn 24. That is, the leather yarn 22 is as easily worked and displays substantially the same characteristics of the wool yarn, except that the leather yarn contributes a "leather hand" to the fabric.

In order for the leather yarn to be capable of being worked by machine needlework and incorporated in a knitted fabric in this way, the leather yarn must have a particular combination of parameters.

Parameters of Leather Yarn

The finished leather yarn has a unique combination of five (5) parameters that are fulfilled in such a way as to enable this leather strand to be used as a yarn in fine clothing needlework and the machine knitting of the same kind of apparel. These five (5) parameters are:

1. Softness;
2. Consistent Thinness of Depth;
3. Consistent Narrowness of Width;
4. Adequate Tensile Strength; and
5. Continuity.

Parameter 1 — Softness:

This is the most important requirement of leather yarn and is the major parameter which distinguishes leather yarn from leather lace. It is this degree of softness characteristic which gives the knitted fabric of leather yarn the drapability and "soft hand" which attracts the fashion market. Further, it is this pliability which allows the yarn to be processed in the abrupt angles involved in knitting machinery. But it is also this softness which creates the major difficulties involved in the cutting process.

This softness is defined in the leather industry as that pertaining to the category "fine garment/dress glove leather". (ASTM Standard Definition of Terms Related to Leather — Designation: D 1517-67 — "Glove Leather: Term covering two distinct classes:

1. The leather used for dress gloves, including those for street, riding, and sportswear. Tanned predominately from hair sheep, wool sheep, and lamb skin and to a lesser degree from deer, pig, goat, and kid skins;

2. The leather used for utilitarian or work gloves and made of a variety of hides and skins, of which the most important are horsehides, cattlehide splits, calfskins, sheepskins, and pigskins".

It is the quality of softness defined as Class 1 above (dress glove) that we use, and one must distinguish it from the more utilitarian type of Class 2, wherein tensile strength and hardiness play a more important role, but with a subsequent loss of "drapability". The softness of leather required for the machine knitting of ladies' apparel is categorized in the leather industry as fine garment/dress glove leather. Getting this type of leather is well within the purview of those skilled in the leather art, and it is concurrent with this skill that the appropriate type of raw skins are chosen.

Such selection and tanning techniques are well known to the skilled worker in the art, and are set forth in such publications as *Chemistry & Technology of Leather,* by Fred O'Flaherty, William T. Roddy, and Robert M. Lollar, Vol. 3, No. 134, at pages 425–446, and *The Leather Workers' Handbook,* J. H. Sharphouse, Leather Producers Association for England, Scotland, Wales, London, at page 103. These leathers are extremely soft. They are defined in *Chemistry & Technology of Leather,* supra., page 425, as being extremely soft, draping like cloth, possessing definite degrees of run, a sort of nonelastic or plastic yield in any direction, with adequate strength. Moreover, objective techniques for determining the softness of leather are set forth in a standard method, E 63-1972 of the *American Leather Chemists Association,* (Annual Book of American Society For Testing And Materials, 1972, part 28, Designation: D 2821-72). Briefly summarized, this standard recognizes that the torsion module of leather is directly related to stiffness, and establishes a test wherein leather samples are subjected to twisting through a torsion wire, and the torque necessary to twist the sample by 90 degrees is measured in degrees of rotation applied to the torsion wire. Fine garment/dress glove leather, having a weight of less than 2½ oz. is defined (Military Specification MIL-L-40051C) as Type I, having a stiffness wherein "Not less than 80 percent of the specimens tested shall have maximum stiffness values of 116 degrees before soaking and 132 degrees after soaking. The remaining specimens shall have maximum stiffness values of 140 degrees before soaking and 155 degrees after soaking." The American Society for Testing and Materials (ASTM) Designation D 1517-67 entitled "Standard Definitions of MS Related to Leather" is also of interest in describing a procedure and mechanism for testing softness by resistance to angular rotation of a strip of the leather.

The skins that we have found to be most appropriate are the young of the animals we use, such as calf, kid and lamb. As mentioned before, they have both greater strength, less loose fibril material, and more pliability. The species which we find most useful are: cattle, sheep, hair sheep (cabretta) goat, pig, buffalo, deer, antelope, and horse. The skins of these animals are thus tanned in accordance with the specifications of fine garment/dress glove leather.

The yarn cut from these tanned skins then has the softness necessary both for knit fashion garments and the pliability necessary for knitting machinery.

In using the torsion module upon lace leather, we found that it measured 720 degrees of stiffness/softness, before reaching 90 degrees of rotation. At this point, the machine started clicking and could not induce any more torque into the stiff leather. This implies that lace leather of the 2 oz. weight is even stiffer than the 720 degrees demonstrated by that machine.

Parameter 2 — Consistent Thinness of Depth:

It is paramount to this invention that the yarn described herein be knittable upon knitting machinery for apparel. In order to comply with the tolerance requirements of this machinery, it is necessary that the input product be made to the same tolerances; if into a machine, the product must come from a machine. Leather is not consistent nor uniform because it is a natural product. The consistency of the depth of the leather is controlled by the quality of the "splitting machines". The splitting machine takes a whole hide, fixed and compresses it, and uses a horizontal band saw, which is extremely sharp, to separate the hide into two or more pieces with the same or nearly the same square area or the original piece. One of these splits will have a grain side on it; the other(s) will not have a smooth side. These splitting machines are well known instruments in the leather art and have been used for many years. They have tolerances of ± ¼ oz. weight which is equal to ± 1/256". The variation is caused by the animals' fibril structure which is determined by the climate, the bruises, sex, hair length, position on the body, and other natural variations. In other words, we are not dealing with a uniform product, such as plastic, and consequently there is no purpose in creating machines with tighter tolerance than the above. (Access to these machines is constantly available to anyone in the leather industry.)

Thus, the consistency of the depth is insured and determined by the "splitting" machine to tolerances on the order of ± 1/256". For the leather yarn of the present invention, the depth of thinness dimensional parameters are:

1½ to 3 oz.
6/256" to 12/256"
0.0234" to 0.0469".

Parameter 3 — Consistent Narrowness of Width:

Both the consistency of the width and the narrowness of the same is determined by machinery and by a system that allows the leather to be accurately cut on that machinery. The cutting machine for this leather yarn performs a vertical separation of one of the splits (either with or without a grain side) into a long continuous untwisted single strand approximately 14/256" wide. The machinery must be finely tuned and balanced in order to maintain the tolerances required for the narrow width of the yarn. The existing lace leather cutting art does not cut lace to the small widths nor the tolerances stated for this leather yarn. As we use the softest kind of leather available, we must add a temporary stiffening compound to give the leather rigidity sufficient to allow accurate cutting. This sizing compound and cutting machinery are described elsewhere in this application. It is both this temporary stiffening and the fine tuning of the leather cutting machinery that maintains a consistent and narrow width of cut yarn. The tolerances are again on the order of ± 1/256", (as in the "splitting" machine) and the parameters of the dimensions of width vary from:

6/256" to 25/256"

0.0234 to 0.0976

The average depth presently used is equivalent to 2½ oz. weight leather or 10/256" or 0.0391", and this corresponds to the average width which is 14/256" or 0.0457". This gives us a ratio of depth to width (cross-section) on the order of 1 to 1½ average. The consistency of the yarn depth or width is insured by the finely tuned machinery and the processes involved. It is important to note that any variations in the width or depth of an abrupt nature is the kind to avoid. A gradual variation does not cause the stop-and-go effect (of an abrupt change) in knitting machinery which leads to jamming, breakage, and eventual down-time — which the highly competitive knitting industry cannot allow.

Parameter 4 — Adequate Tensile Strength:

The yarn has tensile strength sufficient to withstand the stresses imposed upon it while it is knitted by needlework, especially machine needlework, and sufficient strength to prevent tearing or ripping of the knitted fabric when worn. It does not have the degree of strength characterized by leather lace used for bonding or binding two pieces of material together. Its strength is achieved by the selection of leather which has the denseness or tightness of grain inherent to young animals. The tightness of the fibril structure expands or loosens as the animal ages. Further, the individual fibers grow in length and size as well as further apart from each other (characterized by a mature cow). Young animals such as calves have the dense grain structure as well as the elasticity that constitutes the "drapability" of the eventual fabric, and further, as the fibers are smaller and denser, the yarn does not possess much loose fibril material that would jam the knitting machines.

The necessity for the finest grade of leather is mostly due to the small cross-section of yarn needed for knitting machines and the fashion business. This smallness creates unusual stress demands upon the yarn and while ultimate tensile strength is not needed, the leather used for making the yarn does have the inherently high strength of the finest grade of leather.

The leather yarn can be cut from either the split or the grain side of any skin. Depending on the animal, and the tanner's tannage, one might find the split could be stronger than the grain side, or weaker. Either are usable for this product provided that the yarn cut from it fulfills the five parameters needed to define it. A grain leather split naturally produces a contrasting yarn, having both a smooth side and three slightly fuzzy sides.

In the present invention, cattle, cabretta (a hair sheep), deer, pig, antelope, goat, buffalo and horse can be used for the purpose herein. Naturally the young of all these species provide the most desirable leather.

The typical tensile strength breakage for a six inch long leather strand, having a thickness of about 2 oz. or 8/256" and a width of 16/256" are: 4½ pounds for a cowhide strand with an epidermis layer; eight pounds for an antelope; 9 to 10 pounds for a calfskin; and 9 to 10 pounds for a deerskin. These are average typical strengths and are within the minimum tensile strength requirements of the present invention. This should not be construed as limiting on the tensile strength, as this varies from species to species and from tanner to tanner. One must keep in mind that the process of knitting gives greater strength to the fabric through the looping structure than would otherwise be present in the individual strand. This characteristic of knitted fabric allows us to cut the yarn to much smaller cross-sections with the type of leather specified than is done in the leather industry. One must keep in mind that it is the wearability of the fabric and the stresses imposed by the machine knitting operation that constitute the minimum tensile strength requirements.

The leather yarn of the present invention does not require maximum tensile strength. It is characteristic of this leather yarn to have a weaker tensile strength than that of leather strips previously commercially produced which were always directed toward maximum tensile strength. (ASTM designation D 1517-67 — Terms Related To Leather, Lace Leather: A form of rawhide leather (from cattle hides) for lacing together sections of power transmission belts, sometimes prepared also with an alum and oil, chrome, or combination tannage.) The difficulties in cutting an appropriate gloving leather to create such a small strand of leather with such apparently low tensile strength as in the present invention appeared highly impractical and wasteful for the purposes involved with the prior art relating to leather.

It can be noted that calf and kid goat are also the source skins for lace leather, in that they are dense, tight, and strong; but the tanning art directed towards producing lace leather gives a very stiff skin. The tanning art directed toward dress/glove leather gives a very soft skin. It thus requires intentional selection from raw skin through tannage, to the knitting machine, in order to manufacture leather yarn.

PARAMETER 5 — CONTINUITY:

The continuity parameter refers to both the length of yarn necessary to economical operation of knitting machinery, and the continuous embodiment of the four prior parameters. The purpose of knitting machinery is to increase the productivity rate while maintaining a consistent pattern. It goes with this, that the yarn knitted must be able to be worked both quickly and for a long period of time (at least as long as the garment face being produced). This is essentially determined by the length of the yarn available. The unspliced lengths normally available with this yarn are 300 to 1,500 feet. The yarn comes from a circular disc, and it is limited to the smallest width of a hide. It is important to select a tanned skin with the capability of producing up to 40" in diameter for our machinery. (This diameter could be enlarged, but appears adequate for all practical uses.) The diameter dimension should be as large as possible, free of holes, thin spots, scars, weak spots, etc. which would cause breakage in a knitting machine or other use. It follows that this selection of tanned skins is of the first grade or best available in order to avoid these same defects. Further, in the making of leather yarn, shorter unspliced lengths around the 300 foot level or less, and the full 1500 foot piece, are increased in length by the method of splicing. This splicing can be performed by a diagonal slicing of the two pieces to be connected; they are connected through the use of a glue, which is fast acting, strong (small contact area of 0.003 sq. inches), and applicable to leather. The two diagonals, when laid upon each other, approximate the cross-section of the yarn. Several glues have been tried to data. Duco Cement by du Pont, appears to be the best to date.

It is a necessity in the machine knitting industry to avoid breakdowns and/or discontinuation of the machine operations. Short lengths of yarn have the same effect on the knitting machine process as breakage, resulting in down-time for both machinery and manpower, which the highly competitive machine knitting industry cannot allow. The shortest length free of splices usable for us is in the neighborhood of 100 feet and up. The splices, however, are sources of weakness in the leather yarn — they are not exactly the same size, they are somewhat hard and inflexible, and in occasional splices do not take hold. If possible, we try to avoid them. The splices themselves allow these shorter lengths to be amalgamated into one length, giving the continuity that is required in the knitting industry. We make the yarn presently in lengths of 3,000 to 6,000 feet. It goes without saying that in order to be a yarn feasible for machine knitting, that all five of the parameters discussed herein are a necessity for the economical production of fine knitwear garments. This is the requirement for continuity needed for the yarn mentioned herein.

CUTTING AND STIFFENING PROCESS

The leather hide has an irregular shape to it. In order for us to cut the leather into the thin strands, we looked into the following methods:

1. Taking a cammed cutting device which would follow the general contours of the hide;
2. Several parallel blades which would cut the whole hide into strips equivalent to the length of the hide; and
3. Cutting circular discs out of the leather and then cutting those in an inward spiralling motion.

The first method proved to be technically very difficult, as well as expensive. Further, it made no allowances for holes, distortions, or weak spots in the animal's hide. The second method produced lengths that are very short. Consequently, an enormous amount of splicing is needed. This is uneconomical from the point of view of labor costs and time, and also causes jamming of the knitting machinery, because the splices present somewhat irregular cross-sections to the knitting machine channels.

The third system of the circular discs is the one that we use. It allows us, (1) an inexpensive and accurate format for cutting the thin leather strands; and (2) allows us by the method of varying the size of the leather disc, to circumvent holes, weak spots, thin spots, etc.

The method described herein of spinning a circular disc of leather of decreasing size past a stationary fast revolving blade is the most economical to date.

This general kind of machine has been used in the prior art to cut heavy leather. It works well with the heavier leather, in the 4 to 8 oz. range, with cuts from ⅛" to 1", especially with very stiff lace leather. With this kind of cutting machine the strands being cut off the leather disc serve also as the motive force for turning the leather disc. The strand is (after being cut off the circle by the blade) taken off at a constant rate and causes the leather disc to spin faster and faster. The width of the yarn is determined by a pulley which causes an advance of the whole leather disc, equal to the width of the yarn, into the blade per revolution.

When the leather is as soft as ours, this mode of pulling causes ripples ahead of the blade, that eventually pass through the blade. This rippling leads to an abrupt distortion and/or breakage. When the circle is large, the resistance to ripple/wave effect is little, and, as it gets smaller, this resistance increases, but the spinning of the circle also increases dramatically, compounding bunching at the blade.

At this point in the development of the present invention we were baffled as to how to cut soft leather, especially in the narrow widths which we envisioned as necessary for leather yarn. We thought that we needed increased refinement and extra balancing of the machinery, a tabletop surface (on which the leather disc spun) with as little friction as possible; plus a consistently very sharp blade (to cut down on the grabbing effect that the blade has on the leather).

However, more refinement than this was required to consistently cut our thin, soft, narrow leather yarn. We found no way around the fact that the machinery would only cut stiff leather well. So, after refining the machinery (as best we could), we looked at the process backwards. We started looking and working on the leather itself — remembering that the major requirement was soft leather. We decided that we would have to temporarily stiffen the leather, which stiffness would have to be removed in order to make a machine knittable yarn.

This we accomplished through the use of a "sizing" compound, which like the starch that the laundry uses on shirt cuffs, readily comes off the cut strand. In one specific method, the sizing was painted over both surfaces of the circular leather disc and then dried; this is called a "mossing" compound. It does not penetrate the leather very far (acts more as a surface encaser, lending the leather a temporary and somewhat fragile rigidity). The one we use is made by Marine Colloids Corp. Its trade name is SEA CHEM R sizing: This is a calcium carrageenan, and is a seaweed extract. It flakes off when the small strand of our dimensions is purposefully run past many rollers, counters, and scrapers (that purposefully remove the loose fibril material that would otherwise jam the knitting machinery). The strand then returns to the same softness as the leather originally possessed. There are other forms of temporary stiffening compound that fall into these general categories: (1) gelatins, (2) starches, and (3) gum arabics.

The consistency of the cut in these small crosssectional dimensions is necessary. One must take the narrowest width of the yarn, because that is the determining factor in the tensile strength (a chain is only as strong as its weakest length). Further, the non-uniformity of width grabs in knitting machine channels causing the jump-and-go effect, and putting excessive strain on the narrow points, eventually leading to down-time of the knitting machine. The refined machinery and temporary stiffening of the leather allow us to accurately cut soft leather, which process heretofore has not been done. In these ways, (refined machinery and temporary stiffening of the leather), we can cut the soft leather to our dimensions, and to those required by the fine garment industry.

One embodiment of a machine for cutting the leather to produce a leather strand having the required dimensions is illustrated in FIGS. 4–15.

This machine is indicated generally by the reference numeral 40 in FIG. 4 and comprises an upper work surface 42 which supports the leather split 44. The leather split or skin 44 is in the form of a circular disc and is rotatable on the surface 42 so that the periphery of the leather disc is moved past a cutting blade 46. The blade 46 cuts the narrow width strand 48 from the periphery of the leather disc.

The disc 44 of leather is caused to rotate by a pinch roller drive, indicated generally by the reference numeral 52 in FIG. 6.

A spindle 50 has a pair of spaced prongs 54 which are pressed through the center of the leather disc as illustrated. The spindle 50 is mounted for rotation in a block 72. The rotation of the center of the leather disc by the pulling action of the power driven pinch roller 58 in the pinch roller drive 52 rotates the periphery of the disc into position at the cutting blade 46.

As illustrated in FIG. 6 the pinch roller 58 is power driven by a motor 60 and belt drive 62 arrangement, and the power driven pinch roller 58 engages the leather strand 48 between the roller 58 and an upper roller 64.

As the leather strand 48 is cut from the outer periphery of the disc 44, the diameter of the disc steadily decreases, and the center of the disc and spindle 50 must be moved out continuously toward the cutting blade from the central, bold outline position of the disc 44 to the outer position of the spindle 50 and the small diameter disc 44 shown in phantom outline in FIG. 4.

To permit this movement of the spindle 50, the shaft 56 is mounted for rotation in bearings 70 (See FIG. 7.) in the block 72, and the block 72 is in turn supported on wheels 74 which ride on rails 76 at the bottom of a slot 78 in the work supporting table 42.

As best illustrated in FIGS. 8 and 9, the drive for moving the block 72 toward the cutting blade 46 is provided by a weight 80. A wire 82 has one end connected to the block 72 and the other end connected to the weight 80. The wire 82 passes over guide pulleys 84 and around a selected one of three pulleys 88, 90 and 92 connected to a shaft 56. The speed of rotation of the spindle 50 is controlled by the pinch roller 58. By switching the wire 82 from one pulley to another diameter pulley the amount of engagement per rotation of the disc determines the bite of the blade and thus the width of the yarn. This amount per rotation is made substantially independent of the speed of rotation of the disc 44 by the selection of a particular diameter pulley 88, 90 and 92 in relation to the diameter of the disc 44. That is, as the disc gets smaller in diameter, and the disc is caused to rotate faster, a pulley is selected which moves the spindle 50 toward the blade at a faster rate to maintain the width of the cut yarn within the required width tolerances.

It is important to avoid any bunching of the leather disc at the cutting blade 46, since such bunching can cause uneven cuts making for non-uniform width and inconsistent strength yarn. Bunching is a problem because the leather must be very soft in order to produce a satisfactory yarn.

As noted above, the leather disc is temporarily stiffened prior to cutting by adding a sizing. This sizing is called "mossing" with added stiffeners such as starch and gelatin.

The preferred technique for cutting is also to place the grain side down against the supporting surface 42. This permits the leather disc 44 to rotate with less friction than would be the case if the suede side were down. It is possible to cut the disc with the suede side down by placing a sheet of paper or other antifriction material between the leather disc and the supporting surface 42, but this complicates the cutting operation. It is also possible to provide a frictionless air surface with an air float table top construction.

An intermediate sheet such as light cardboard may also be used to help support and stiffen soft leathers during the cutting operation, but this also adds a complication to the cutting operation.

Figure 15:
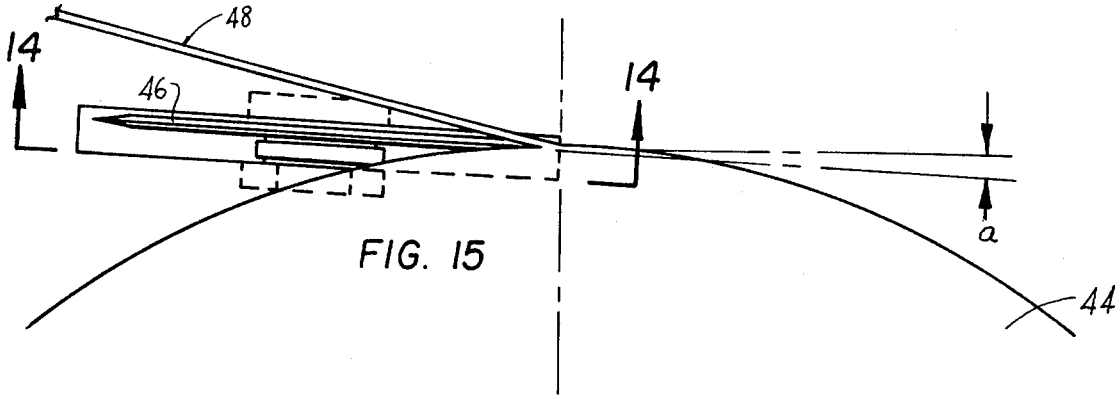
FIG. 15 is an enlarged plan view of the cutting blade of the FIG. 4 machine and shows details of how the blade cuts the leather strand from the periphery of the skin.
Figure 14:
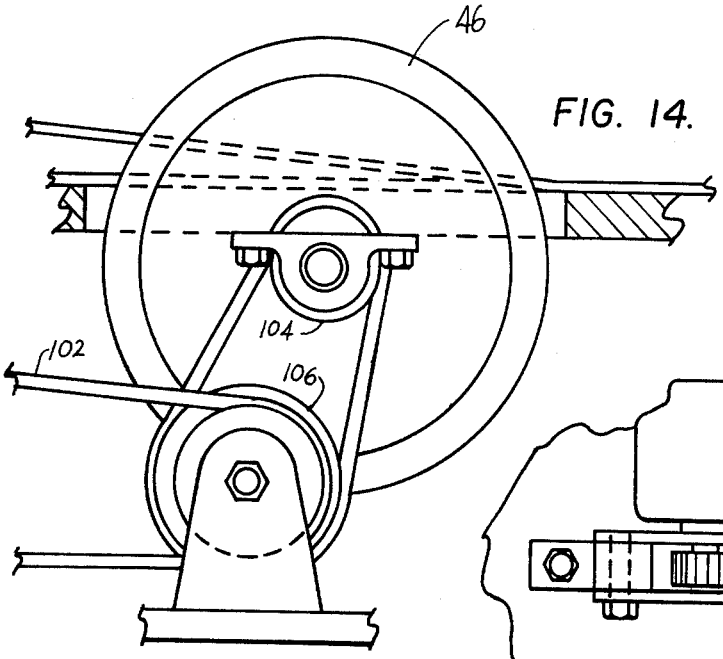
FIG. 14 is an enlarged side elevation view taken along the line and in the direction indicated by the arrows 14—14 in FIG. 15.

The cutting blade 46, as best illustrated in FIGS. 14 and 15, is a rotary blade driven by belts 100, 102 and pulleys 104 and 106. The blade is disposed at a small angle A with respect to the tangent to the periphery. The angle A is preferably in the order of 1–3 degrees depending on the amount of the disc bite at the blade.

Figure 3:
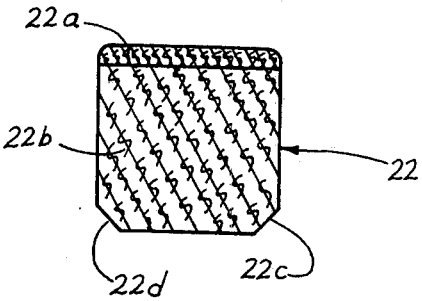
FIG. 3 is an enlarged cross-section through the leather yarn taken along the line and in the direction indicated by the arrows 3—3 in FIG. 2.

After the very narrow width strand 48 has been cut from the periphery of the disc 44, the strand is passed over or below a pair of power driven beveling blades 108 and 110 as best illustrated in FIGS. 10 and 11. These beveling blades bevel off the corners to form the surfaces **22*c* and 22*d* as illustrated in FIGS. 12, 13 and 3**, in order to remove loose fibril material that would otherwise jam knitting machinery.

A series of guide pulleys 112, 114, 116, 118, 120 and 122 guide the cut strand 48 past the beveling blades 108 and 110 to the pinch roller drive 52. A yardage counter mechanism 124 illustrated in FIG. 4 may be driven from the roller 64 of the pinch roller drive.

The cutter 40 also has a control panel 126.

The circular cutting blade 46 is continuously sharpened, and the blade rotates at a relatively high RPM (1750 RPM) to minimize possible distortion (i.e., non-uniform width caused by grabbing of the blade with the surface of the skin rather than cutting it) in the cutting operation. Any such distortion can lead to breaks and places a limitation on the narrowness to which the strand can be cut.

Figure 17:
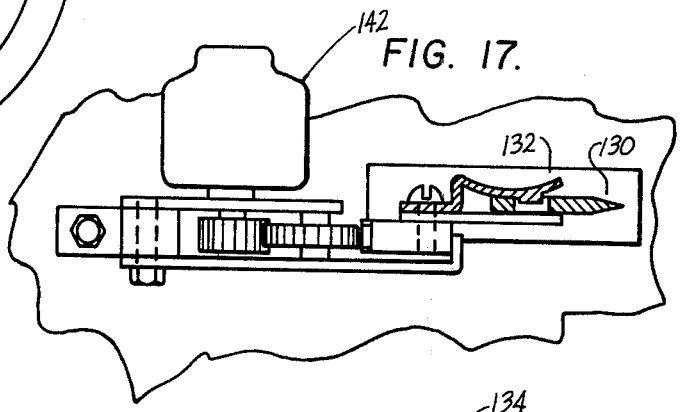
FIG. 17 is a fragmentary enlarged top plan view taken along the line and in the direction indicated by the arrows 17—17 in FIG. 16.
Figure 16:
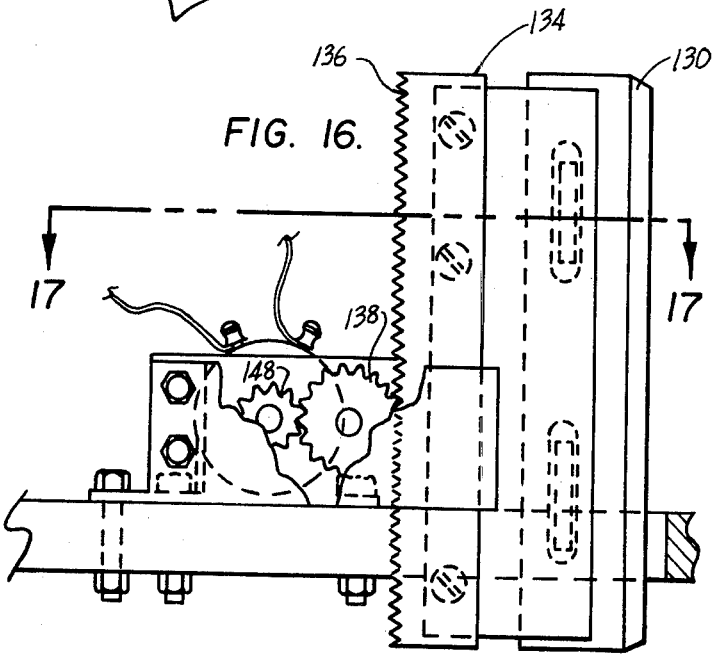
FIG. 16 is an enlarged side elevation view like FIG. 14 but shows a second embodiment in which a straight, non-rotating cutting blade is used in place of the rotary cutting blade of the FIG. 14 embodiment.

FIGS. 16 and 17 shows a second embodiment which uses a replaceable cutting blade, much like the replaceable blade in a safety razor, and which has some disadvantages.

In the FIGS. 16 and 17 embodiment a cutting blade 130 is held vertically by a spring clip 132 in a carriage mechanism 134. The back edge of the carriage mechanism 134 has a gear rack 136 which is engaged by a drive gear 138. The drive gear 138 is in turn driven by reduction gears 140 and a motor 142.

In the operation of the FIGS. 16 and 17 embodiment the straight replaceable razor blade 130 is held in place by a support carriage 134, and the drive motor 142 moves the blade downwardly slowly to keep a sharp edge continuously presented to the leather disc. Thus a 6-inch long blade may be moved downwardly at the rate of about one inch every 5 minutes, and the blade is replaced after it has been used one time. This blade has the advantage that it does not push the skin in the direction of movement because it moves too slowly to be noticed. The replaceable blade does not need to be resharpened and the vertical movement of the blade enables a new sharp face to be presented to the leather at all times. Thus, it is possible to cut quite narrow width yarn.

The present invention thus provides a method for producing a unique leather yarn and enables a combination of five (5) parameters to be obtained which makes the yarn entirely suitable for working into knitting fabrics by needlework, especially machine needlework for fashion garments.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

While we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims.

We claim:

1. A method of manufacturing a leather yarn having a combination of parameters which enable the yarn to be acceptable for and readily worked by garment knitting machine needlework into a knitted fabric having a soft leather hand, said method comprising, selecting a leather piece having the softness characteristics of fine garment/dress glove leather and having a weight in the range of 3 oz. to 1½ oz. as measured by a standard leather thickness gauge, temporarily stiffening the soft leather piece to a sufficient extent to enable a narrow width strand to be continuously machine cut from the periphery of the leather piece without bunching of the leather piece at the point of cutting, machine cutting a long, continuous, untwisted, leather strand of substantially uniform width not greater than about 4/32 in. from the periphery of the leather piece, manipulating and scraping the cut strand to remove loose fibril material which could clog up the mechanisms of knitting machines, returning the cut leather strand to the softness of the leather piece existing prior to said temporary stiffening, and winding the leather yarn on spools for subsequent use in machine knitting operations.

2. The invention defined in claim 1 wherein said cut strand has a width in the range of about 4/32 in. to about 1/32 in. and the width does not vary more than plus/minus 15% throughout the length of the cut strand.

3. The invention defined in claim 1 wherein the leather piece is a circular disc and the leather strand is cut as an inward spiral from the periphery of the circular disc and including cutting the strand by a cutting blade mounted at a fixed location, rotating the periphery of the leather disc past the cutting blade, and moving the center of the disc radially toward the cutting blade at a rate to maintain the width of the cut substantially constant as the rate of angular rotation of the disc increases with the decreasing overall diameter of the disc.

4. The invention defined in claim 3 including adjusting the rate of movement of the center of the disc toward the cutting blade to produce yarns of different widths.

5. The invention defined in claim 1 wherein the temporary stiffening includes adding sizing to both lateral surfaces of the leather piece.

6. The invention defined in claim 5 wherein the step of returning the cut leather strand to the softness of the leather piece existing prior to said temporary stiffening includes bending the cut strand to remove the sizing.

7. The invention defined in claim 1 wherein the leather piece is a grain leather and including supporting the leather piece on a support table and rotating the periphery of the leather piece past a cutting knife mounted at a fixed location on the table and placing the grain side of the leather piece against the support table to minimize the friction between the leather and the table.

8. A leather yarn made by the method defined in claim 1.

9. The invention defined in claim 8 wherein the leather yarn has a stiffness of less than 116° before soaking and less than 132° after soaking as determined by the Standard Method for Measuring the Relative Stiffness of Leather by Means of a Torsional Wire Apparatus of the American Leather Chemists Associates.

10. The invention defined in claim 8 wherein the yarn has sufficiently dense grain to provide adequate tensile strength throughout its length for any given weight for the purposes of machine knitting and wearability.

11. The invention defined in claim 8 wherein the width is about 3/32 in. and the weight is about 1¾ to 2 oz. so that the yarn approaches a tubular, cylindrical yarn.

12. The invention defined in claim 8 wherein the yarn has a length in the range of 30 to 1000 yards without splices.

13. The invention defined in claim 8 wherein the yarn is cut from a leather selected from the group exemplified by cattle skins, sheep skins, deer skins, goat skins, horsehides, and antelope skins.

* * * * *